US006595810B1

(12) United States Patent
Kenny

(10) Patent No.: US 6,595,810 B1
(45) Date of Patent: Jul. 22, 2003

(54) ELECTRICAL CONNECTORS AND CONNECTION SYSTEM

(75) Inventor: Mark Kenny, Jensen Beach, FL (US)

(73) Assignee: Pro Equipment, LLC, Jensen Beach, FL (US)

( * ) Notice: Subject to any disclaimer, the term of this patent is extended or adjusted under 35 U.S.C. 154(b) by 0 days.

(21) Appl. No.: 09/986,187

(22) Filed: Nov. 7, 2001

(51) Int. Cl.[7] ..... H01R 11/22

(52) U.S. Cl. ..... 439/849; 439/848; 439/923; 439/106

(58) Field of Search ..... 439/848, 849, 439/923, 106, 346, 188, 102

(56) References Cited

U.S. PATENT DOCUMENTS

| | | | | | |
|---|---|---|---|---|---|
| 1,341,468 | A | * | 5/1920 | Kenney | 200/51 R |
| 2,026,755 | A | * | 1/1936 | Stem | 439/686 |
| 3,676,831 | A | | 7/1972 | Bergwall | 339/74 |
| 4,544,216 | A | | 10/1985 | Imhoff | 339/14 |
| 5,082,450 | A | | 1/1992 | Warren, Sr. et al. | 439/102 |
| 5,194,013 | A | | 3/1993 | Propp | 439/265 |
| 5,249,976 | A | | 10/1993 | Brock | 439/102 |
| 5,641,310 | A | | 6/1997 | Tiberio, Jr. | 439/680 |
| 5,680,926 | A | | 10/1997 | Sandor et al. | 200/51.08 |
| 5,741,149 | A | | 4/1998 | Anthony | 439/333 |
| 5,803,770 | A | | 9/1998 | Swendson et al. | 439/676 |
| 5,993,255 | A | | 11/1999 | Yurko | 439/595 |
| 6,050,837 | A | | 4/2000 | Duhe, Jr. | 439/270 |

FOREIGN PATENT DOCUMENTS

| | | | | |
|---|---|---|---|---|
| CA | 465719 | * | 6/1950 | 439/188 |

* cited by examiner

*Primary Examiner*—Tho D. Ta
(74) *Attorney, Agent, or Firm*—Tangent Law Group; Eric J. Weierstall

(57) ABSTRACT

An electrical receptacle having a body member, the body member having at least one blade-engaging member with a first and second portion spaced apart one another, a bridge portion, and at least one side structure spaced between the first and second portion, with at least one electrical lead coupled to the body member and at least one protrusion located on the body member that releasably engages and disengages a corresponding blade member absent the presence of an externally actuated release mechanism. Also including the electrical connector system having a male plug member having at least one blade with at least one recess. A female connector having at least one blade engaging member. The blade engaging member having a first and a second portion, an at least one side structure located between the first and second portion, a bridge portion and at least one protrusion, where the at least one protrusion is located along the blade engaging member and engages the at least one recess on the male plug, wherein said system has a first and second blade and a ground member.

41 Claims, 4 Drawing Sheets

ELECTRICAL CONNECTORS AND CONNECTION SYSTEM

FIELD OF THE INVENTION

The invention is directed to an electrical connection system and connectors that resist inadvertent release. More specifically a connection system having a specially designed female connector that mates with a correspondingly specially designed male plug, in one exemplary embodiment, or a standard male plug, in another exemplary embodiment, and resists inadvertent release.

BACKGROUND OF THE INVENTION

Electrical connection systems to date have generally included molded male plugs having two to three electrical elements, typically having at least two blades. These plugs connect to corresponding two and three element female connectors, for instance at a standard wall jack or extension cord terminus, and carry electricity to various devices. The tenuous connection between the components of a typical electrical connection is facilitated by a friction fit of the electrical elements within the respective female terminus. Often, in light duty work, this simple friction fit is sufficient.

However, as more communities limit the use of gasoline powered devices for outdoor use, heavier duty outdoor use of electrically powered devices and the power cords that supply them with electricity is on the rise. These devices are being used increasingly by both homeowners and professionals in these heavier duty applications, for example in lawn care applications. In numerous indoor applications, for example, when using hand held saws and drills in a workshop, a standard friction fit is often also insufficient. Therefore, there is an increased need to maintain electrical connections to these devices for the sake of efficiency and safety in commercial and non-commercial applications.

Although several attempts at achieving improved electrical connections that resist disconnection have been made in the past, they all have significant shortcomings. Often in the heretofore known solutions, the safety of the consumers and their children and the potential for accidents has been overlooked. The electricity carried by electrical power cords from electrical outlets to a multitude of electrical devices can be highly dangerous. It is quite capable of inflicting serious injury or even death to anyone who comes into direct contact with it, but especially children.

Dangerous contact with large amounts of electrical energy can happen in many ways. For instance, a partially plugged in electrical connector is still capable of carrying electrical energy to contacted body parts, especially the small fingers of children, resulting in electrical shock.

Another danger arises from intermittent engagement of electrical devices that are partially plugged in, especially in outdoor use of heavy electrical equipment, such as the user of trimmers and power saws. The user of the electrical device may turn the device on, observe no action, and assume the device is not powered. However, a slight jostling of the electrical cord may provide power to the device unbeknownst to the user. The user may have been treating the powered device as though it were not powered, and serious injury may result.

Another potential danger arises if, in attempting to cut power in an emergency, the electrical plug has a plug-locking device that cannot be easily reached or disengaged. In this situation, the heretofore known locking electrical plugs that were designed and built to safely maintain an electrical connection become hazards unto themselves.

The inherent dangers of handling electricity are not new, nor are the concepts of locking electrical connectors and connector systems. Many designs exist for locking electrical plugs as a solution to these dangers. However, the majority of these solutions, while providing for maintenance of these connections against accidental disconnection, provide little or no consideration for safe and immediate disconnection of the electrical connections in emergency situations. In fact, these designs do not meet Underwriter's Laboratories (hereinafter UL) guidelines and, therefore, are not approved by this recognized consumer safety organization.

UL has written safety guidelines for the minimum and maximum safe pulling forces that should be applied to remove an electrical plug from an outlet to help mitigate these risks. These guidelines are published in the UL publication Standards For Safety for Attachments, Plugs and Receptacles, incorporated herein by reference, and rule 498 of this publication specifies a minimum of between three (3) pounds pulling force and a maximum of fifteen (15) pounds pulling force for disconnection in household use. In the heretofore known lockable plug designs, with few exceptions, these specifications have not been heeded.

Several designs attempting to improve the standard electrical connection modify the male plug in an electrical connection system. Many of these existing designs require the presence of a ground pin to function (e.g. Brock, U.S. Pat. No. 5,249,976, Warren, Sr. et al., U.S. Pat. No. 5,082,450, and Imhoff, U.S. Pat. No. 4,544,216). Although the use of ground pins is generally accepted as safer than the alternative, their use is hardly universal. Moreover, no consideration is given to the safe, rapid release of the electrical connection without engaging a release member.

Similarly, other locking plug designs require the use of a turning tool, typically used in conjunction with the male connector (e.g. Propp, U.S. Pat. No. 5,194,013 and Cohen, U.S. Pat. No. 3,345,603) to disengage blades or ground pins. Unplugging these plugs without their respective turning tools, which may not be available in an emergency situation, would require forces well outside those of the stated UL Labs safe maximum pulling force and suffer from similar problems as those with release mechanisms.

These existing locking plug designs, e.g. Brock, U.S. Pat. No. 5,249,976, Murchison, U.S. Pat. No. 3,390,404, Bergwall, U.S. Pat. No. 3,676,831, Baker et al. U.S. Pat. No. 3,267,408, Hime, U.S. Pat. No. 3,187,291, and many others like them, simply do not disengage by pulling on the electrical cord with a deliberate amount of force, especially within the specified force of the UL Guidelines. To release these plugs in an emergency would require forces that would destroy the plug or the receptacle to which they were attached. These plugs are, therefore, an inherent safety concern. The inability or difficulty in disengaging these devices in emergency situations outweighs the limited benefits provided by the increased resiliency in the electrical connection.

Even U.S. Pat. No. 6,050,831, to Duhe, Jr., which specifically mentions the UL guidelines, still requires depressing an external shaft that contacts a securement arm internal to the plug body to engage and disengage the plug. A user wishing to release the locking mechanism has to apply pressure to the shaft to achieve an unlocked position. Thus there still exists a problem with effectuating quick release of the electrical connection. Although the plug may be pulled free with forces within the specified UL guidelines in an emergency, doing so results in damage to the plug. Additionally, with Duhne, as with all the other locking plug designs, there is a significant increase in the number of components and manufacturing steps needed to produce the plug. This makes all of these designs prohibitively complex and costly for mass production.

In regards to known female connector designs that resist release, a series of marine or heavy-duty industrial locking type electrical connectors are well known in the art. These locking connectors do not consider safe release of the connection as an important feature. For instance, U.S. Pat. No. 5,641,310 to Tiberio, Jr. is just one example of such a locking system where typically a male blade assembly with specially adapted blades, is designed to engage a corresponding locking cut-out in a female connector and thereby lock the connectors. This requires a twisting motion to lock and unlock the connectors and cannot be pulled apart to effectuate safe disconnection. Additional examples of these types of systems include U.S. Pat. No. 5,741,149 to Anthony and U.S. Pat. No. 5,680,926 to Sandor et al.

Other female electrical connectors that carry projections are also known in the art. Patents such as U.S. Pat. No. 5,803,770 to Swendson et al. describes female connectors with projections. These devices utilize these projections as alignment guides. The guides do not assist in safely maintaining a releasable connection against accidental disconnection. Similarly, U.S. Pat. No. 5,993,255 to Yurko discloses an electrical connector assembly with a high-density plug connector that includes a female terminal with resilient latches. However, even these latches must be engaged using a mechanical assist device and they do not consider safe release of the electrical connection in emergency situations.

Thus, in all of the heretofore known designs, a user is required to physically damage the locking plug or the electrical outlet to unplug the electrical connection in an emergency without operating an external release mechanism or performing a special release function. Additionally, manufacturability, and thus product reliability at a reasonable cost to the consumer, is rarely addressed, especially with older locking plug designs.

Therefore, a need exists for a locking electrical system capable of remaining connected under rigorous usage, capable of remaining plugged under the small pulling forces experienced during normal use and also the small forces provided by children, and capable of being unplugged by the application of a reasonable pulling force without the need for activation of an external release mechanism. In addition, there exists a need for a locking electrical plug that is reliable and cost effective to both produce and purchase, and one that can be implemented easily in existing devices.

SUMMARY OF THE INVENTION

An advantage of the instant invention includes providing an improved electrical connection system for mechanically resisting disconnection.

A further advantage is providing an improved electrical connector, which meets or exceeds UL guidelines for release forces.

An additional advantage of the instant connection is a cost effective solution to provide an electrical connection that resists disconnection, but is safe in emergency release situations.

A still further advantage of the instant invention is the added safety of not having to depress a release mechanism to effectuate release.

Yet another advantage of the instant invention is that the female connector can be used with a conventional plug to provide a resilient connection.

A still further advantage of the invention is an improved electrical connection system that can be incorporated in a wide variety of applications and uses.

The invention includes an electrical receptacle and an electrical connector system.

The electrical receptacle includes a body member, the body member having at least one blade-engaging member with a first and second portion spaced apart from one another, a bridge portion, and at least one side structure spaced between the first and second portion. The receptacle also has at least one electrical lead coupled to the body member and at least one protrusion located on the body member that releasably engages and disengages a corresponding blade member absent the presence of an externally actuated release mechanism.

The electrical lead can be coupled to the blade-engaging member. The side structure can be a portion of the body member. The at least one protrusion can also be on the blade-engaging member. The side structures can also extend from the first portion of the blade engaging member. The at least one protrusion can be located on the first portion of the blade engaging member. The at least one protrusion can be located on a side structure. A further aspect of the invention includes an at least one protrusion that can be located proximate to an end of the at least one side structure portion, closer to but spaced from the bridge portion.

The at least one protrusion can have first more gradual slope extending from the at least one side structure of the first and a second sharper slope returning to the at least one side structure, defining a highest point for engagement between said first and second slopes. The first slope can extend from the at least one side structure at an angle of between about 3 degrees to about 45 degrees relative to the side structure. The second slope can return to said side at an angle of between about 20 degrees to about 85 degrees relative to the side structure. The at least one protrusion can be, in an exemplary embodiment, between about 1 mm and about 10 mm in length, between about 1 mm and 10 mm in width, and between about 0.5 mm and about 5 mm in height. The at least one protrusion can have a diameter of between about 1 mm to about 10 mm. The at least one protrusion can be one of a circular, ovoid, teardrop, and rounded shape.

The at least one protrusion can be shaped to engage a corresponding number of receiving portions or recesses in a blade member. The at least one protrusion can further include only a single protrusion on said blade-engaging member. The at least one protrusion can include multiple protrusions.

The at least one protrusion can also be located on the second portion of said blade-engaging member to engage a corresponding receiving portion or recess in the blade member. The protrusion can further include a first part of the protrusion closer to a first end of the body member having a gradually rising slope from the second portion and a second part located further from the front end of the body member, having a sharply angled second slope returning to the second portion. The electrical receptacle can have a first slope that rises from the second portion at an angle of between about 3 degrees to about 45 degrees. The electrical receptacle can have a second slope that returns to the second portion at an angle of between about 20 degrees to about 85 degrees.

The electrical receptacle can further include both a first protrusion and a second protrusion. The first protrusion can be located on said first portion, on an at least one side structure extending from the first portion. The second protrusion can be located on the second portion of the body member, near an end of the second portion closest to a receiving end of the body member. The first protrusion can engage a corresponding first receiving portion and said second protrusion can engage a corresponding second receiving portion in the blade member.

The electrical receptacle can further include an at least one blade guide channel corresponding to the at least one blade-engaging member. The at least one blade guide channel can precede the corresponding at least one blade-engaging member and guide a corresponding blade member to the at least one protrusion on the at least one blade-engaging member. The at least one blade-engaging member can be substantially shorter than said at least one blade, so as to necessitate full insertion of the blade into and along the blade guide channel to fully engage the blade-engaging member.

The said at least one protrusion can be a component of an electrical switch, where the switch is actuated by fully engaging the blade-engaging member and, thereby, the at least one protrusion. The electrical switch can be, for example, at least one of a contact switch and an electrical interrupt switch.

The electrical receptacle can further include at least one adjustment mechanism to adjust the at least one protrusion. The adjustment mechanism can effectuate a change in the position of the highest point for engagement between the two slopes. The at least one adjustment mechanism can be at least one of a screw, a resilient member, a ratcheting bolt or other adjustment mechanisms.

The electrical receptacle can further include having a visual indicator to indicate different ranges of disconnection forces for releasably engaging and disengaging the corresponding blade in the electrical connector. The visual indicator can be a color-coded body member.

The electrical receptacle can include a first portion of said blade-engaging member that terminates adjacent the bridge portion and a first side and a second side structure that extend therefrom.

The electrical receptacle of the instant invention can be mounted in a wall plug. The instant invention can also be modified for at least one of 110, 220, 440, and 660 volt applications.

The protrusion can disengage the blade upon an application of force of at least about three pounds force and at most about fifteen pounds force.

The system of the invention includes an electrical connector system having a male plug member with at least one blade and at least one recess. The electrical connector system further includes a female connector having at least one blade-engaging member, the blade-engaging member having a first portion, a second portion, at least one side portion located between the first and second portion, a bridge portion and at least one protrusion. The at least one protrusion being located along the blade-engaging member and engaging the at least one recess on the male plug member.

The system can have a first and second blade and a ground member. The system can further include one blade-engaging member, which engages the first blade. The electrical connector system can further include first and second blade-engaging members, each engaging respective first and second blade in a corresponding first and second recess.

The at least one protrusion can engage a corresponding side of the blade furthest from the body member. The female connector can also be housed in a wall outlet.

The apparatus of the invention also includes means for conducting electricity. The means for conducting electricity is coupled to the means for engaging an electrical connection and has at least one protrusion for resistively engaging and disengaging said connection absent an external release means.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the accompanying drawings, where the same reference numerals refer to the same features.

DETAILED DESCRIPTION OF THE DRAWINGS AND EXEMPLARY EMBODIMENTS

A non-limiting, exemplary embodiment of the improved electrical connection system of the instant invention is shown in FIGS. 1–6.

Figure 1B:
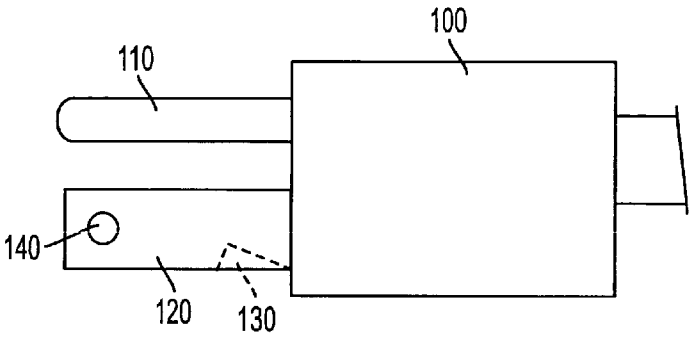
FIG. 1B shows a side view of an exemplary embodiment male plug of the instant invention.
Figure 1A:
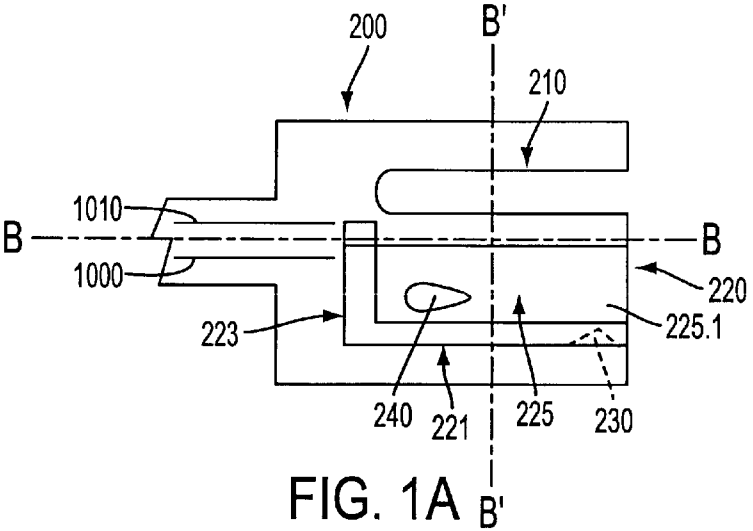
FIG. 1A shows a cross-sectional view of an exemplary embodiment of the female connector of the instant invention.

FIG. 1A shows a cross-sectional view of an exemplary embodiment of the female connector of the instant invention. The receptacle comprises a female body member 200 that can be constructed from, for example, molded plastic material, ceramics, or any other suitable material. The female body member contains at least one ground connection 210 and at least one blade-engaging member 220. The blade-engaging member 220 has an first, in this case upper, portion 225, a second, in this case lower, portion 221 and a bridge portion 223. Further, along the first portion 225 of the blade-engaging member, a first protrusion 240 is provided. In the exemplary embodiment, the first protrusion is located towards the back of the first portion of the blade-engaging member 220, closer to the electrical leads 1000, 1010, along a first side 225.1 of the first portion 225, as seen in FIG. 1A. A further embodiment of the instant invention includes an optional second protrusion 230 located on the second portion 221 of the blade-engaging member 220 (shown in dashed lines). This optional second protrusion 230 is designed to engage a corresponding male member having optional receiving portion 130, as seen in FIG. 1B. This optional second protrusion may be used in conjunction with or alone as an alternative to the first protrusion 240. Although the exemplary embodiment shown in FIGS. 1–6 has the protrusions 240, and 230 as a part of the blade engaging member 220, the protrusions may alternatively be part of the body member 200 or a separate element all together. For instance, the protrusions may be molded as part of body member 200 or may be separately attached as adjustable plastic screws within the body member 200. The protrusions may also include several protrusions at various locations, for instance protrusions on both sides of the first portion 220 or other multiple protrusion embodiments.

FIG. 1B shows a side view of an exemplary embodiment of a male plug of the instant invention. This embodiment of the male plug comprises a male plug body member 100, constructed, for example, from a molded plastic material or other suitable material such as any hard plastics or ceramics. Extending from the male plug member and electrically coupled to the device from which the male plug extends is at least one ground member 110 and at least one blade 120. The at least one blade 120 having at least a first recess 140. The at least one blade 120 and at least one ground member 110 may be constructed, for example, of steel, copper, alloys, nickel, aluminum or any suitable material. In the exemplary embodiment shown in FIG. 1B, a standard polarized plug is shown having a circular first recess, in this case a cutout, 140 is impressed into the blade as shown. In a further embodiment of the instant invention, an optional second recess 130 located along the second portion of the blade 120 is included (shown in dashed lines). This optional receiving portion can be used in conjunction with or alternatively to the first recess 140 for engagement within the female connector, as described below.

In engaging the system of the instant invention, an operator slides the at least one blade 120 of the male plug into the female body member 200. The at least one blade 120 slides into the at least one blade-engaging member 220. The plug is inserted into the female terminus. Although single and double bladed male plugs are shown, the instant invention may be adapted to engage any number of blades with any number of blade engaging members as described. This engages, in a first exemplary embodiment, the first recess 140 with the corresponding first protrusion 240. As described further below, typically this first recess 140 is circular and the corresponding protrusion can be a circular or teardrop first protrusion 240, as depicted in FIG. 1A, although any number of shapes may be utilized. In further exemplary embodiments a similar procedure may be utilized to engage the second optional recess with the second protrusion in conjunction with or as an alternative to first recess 140 and first protrusion 240. The recesses and protrusions engage in such a way as to resist disengagement. In the exemplary embodiments, this is manifested in a required pulling force of between about 3 pounds force and 15 pounds force to disengage the connection.

Figure 2:
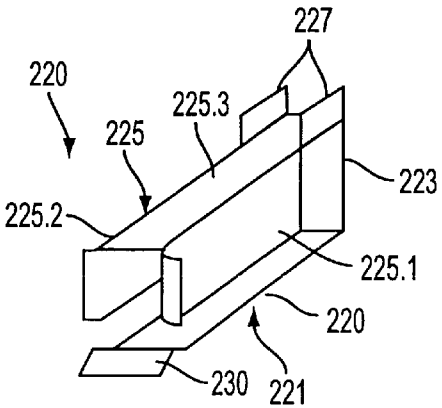
FIG. 2 shows an isometric view of the improved blade engaging member of the exemplary embodiment of the female connector of FIG. 1A.

FIG. 2 shows an isometric view of the improved blade engaging member of the female connector of FIG. 1A. The blade engaging member 220 is shown in an exemplary embodiment comprised of a single piece of metal. The first portion 225 of the blade-engaging member is bent in a U-shape, wherein the first and second side structures or sides of the receptacle 225.1, 225.2 extend from the center of the first portion 225.3. In other exemplary embodiments, this first portion 225 can be terminated adjacent the bridge portion 223, with just the side structures 225.1,225.2 and side flaps 227 extending out from about the terminus of the bridge portion without a center portion. The center of the first portion 225.3 extends to the bridge portion 223, with side flaps 227 extending, in this case oppositely in direction, from the center of the first portion 225.3. The bridge portion 223 connects to the second portion 221, which can extend underneath the first portion 225 of the blade-engaging member 220, as shown in FIG. 2. The bridge portion 223 is spaced from the side portions 225.1, 225.2 and the center portion 225.3 of the first portion 225 of the blade-engaging member to allow flexing of the various portions with respect to one another. The second portion 221 is spaced from the bridge member 223 and first portion 225, providing a gap between the second portion 221 and the side portions 225.1 and 225.2. This allows the second portion 221 to flex, downward in the embodiment depicted, to engage the optional second protrusion 230 with the corresponding optional recess 130. This also allows for the side portions 225.1, 225.2 to flex and engage said first protrusion 240 with first recess 140. This also allows for adjustment of the pressure with which either protrusion engages the blade, as discussed further in relation to FIGS. 5 and 6 below, and provides for easier engagement of the connection. The alternate embodiment discussed above, having the optional second protrusion 230, is shown in FIGS. 2 and 3.

Figure 3:
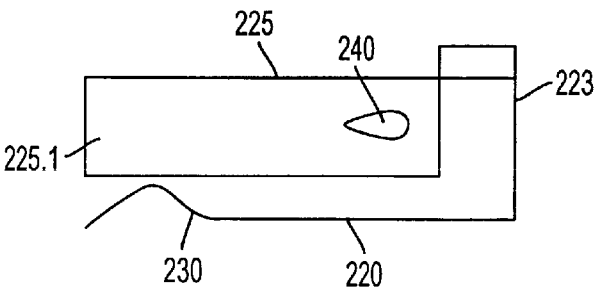
FIG. 3 shows a side view of the blade receptacle of FIG. 2.

FIG. 3 shows a side view of the blade receptacle of FIG. 2. In this figure, the first protrusion 240 is also shown together with the optional second protrusion 230. The exemplary embodiment of the first protrusion 240 is preferably shaped with a teardrop shaped first part with a circular second part. Additionally, the protrusion can be shaped, as a circle, an ovoid, an irregular circle, or any appropriate shape and is generally located in a position to engage corresponding first receiving portion 140 in the male member. In the exemplary embodiment shown in FIG. 1B, the first receiving portion 140 is, for example, a circle. However the recesses can be of any size or shape and the protrusions can be designed to engage the correspondingly shaped recesses.

When the blade 120 of male member 100 is inserted into the female body member 200, the protrusion engages the receiving portion in a releasable fashion. By engaging the blade-engaging member 220 with the blade 120, an electrical connection is also made. In an exemplary embodiment, the release strength of the connection is maintained within the listed safety requirements from the UL guidelines, that is about 3 pounds-force to about 15 pounds-force. When the electrical connection is made the plug resists removal from the female body member within this range of force. However, in an emergency, an adult can easily effect release with a strong pull exceeding this threshold and thereby disengage the electrical connection. This is one of several advantages of the instant invention, providing a safe and reliable connection that resists disconnection, but can be disconnected rapidly and safely in an emergency, with an exemplary pulling force for such disconnection being dictated by the UL lab guidelines. The force required to withdraw the connection can be modified for heavier applications and specifications, for 110, 220, 440, 660, etc. volt systems for example, by changing the thickness of the materials. This can be done in conjunction with or alternatively to increasing or decreasing the angles of engagement of the protrusions.

Figure 4B:
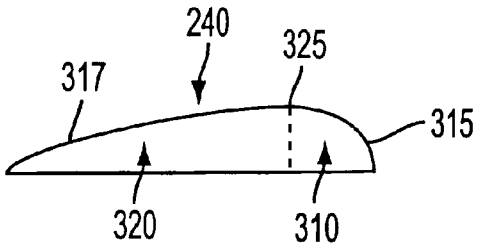
FIGS. 4A and 4B shows a close up view of an exemplary protrusion of the embodiment of FIG. 3.
Figure 4A:
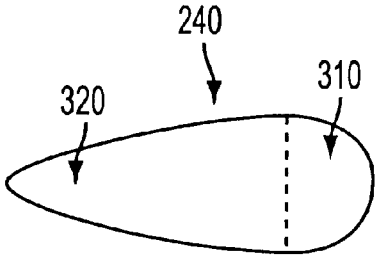

FIGS. 4A and 4B show a close up view of an exemplary protrusion of the embodiment of FIG. 3. An exemplary first protrusion 240 is shown in a teardrop shape with a tapered, gradually rising slope 317 on a first part 320 and a dome shaped second part 320. The tapered angle of the slope of the first part 317 returning to the portion from which it protrudes, from the side can, for example, be varied between about 3–4 degrees to between about 40–45 degrees relative to the side structure or portion it rises from. In the exemplary embodiment, the rounded second half drops from the high point of engagement 325 and has a sharp decreasing angle on a downward slope 315. This angle of return can be varied from about 20 degrees to about 85 degrees relative to the face of the side or portion to which it returns. The tapered first part 320 is provided in a fashion that allows the blade 120 to easily slide up and over the high point of engagement 325 of the protrusion.

Alternatively, as mentioned above, various shapes of protrusions may be utilized and the angles suitably varied. In particular, further exemplary embodiments of these protrusions have utilized circular die punch techniques to provide a circular protrusion. The angles of the circular or dome shaped protrusion can be varied to provide a targeted range of resistance, for example within the range of the UL guidelines cited above, for withdrawal of the male member. These variations can be indicated by various visible indicators, for instance various colored body members. Similarly, these color indicators may be used to identify varying voltage applications.

Figure 5:
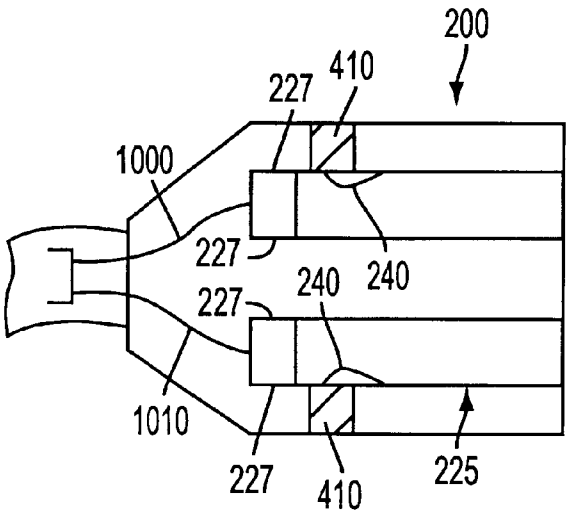
FIG. 5 shows a horizontal cross sectional view of an additional embodiment of the female connector of the instant invention along line B—B.

FIG. 5 shows a horizontal cross sectional view of an additional embodiment of the female connector of the instant invention along line B—B. FIG. 5 shows two blade-engaging members 220 with first protrusions 240, these are shown together with adjustment mechanisms 410. The adjustment mechanisms 410 can be used to adjust the point of engagement of the protrusion or the highest point of engagement of the protrusion and thereby the pressure applied in engaging blades 120. These adjustment mechanisms facilitate both a greater range of release tensions in the invention and extend the period of use for the instant invention. For instance, as frictional wear between the blade 120 and the first protrusion 240 reduces the height of the protrusion, the adjustment mechanism can effectively restore the placement the protrusion and, thereby, restore the release tension. An exemplary adjustment mechanism, for instance, is a plastic screw contained in the housing of female body member 200, although any suitable adjustment mechanism may be used. Alternatively, a single adjustment can be provided to engage and adjust either protrusion. Similarly a single or modified blade-receiving member may be used in place of the multiple blade receptacle system.

FIG. 5 also shows the connection of electrical lead elements 1000, 1010 to the blade-engaging member 220. These electrical leads, comprising at least one negative and at least one positive lead, can be attached to the blade-engaging member 220 at upwardly turned side flaps 227 which extend upwardly from blade-engaging member 220. In an exemplary embodiment, the upwardly turned side flaps 227 are crimped down onto one of the corresponding electrical leads 1000, 1010. Alternatively any conventional means or mechanism for making an electrical connection may be used.

Figure 6:
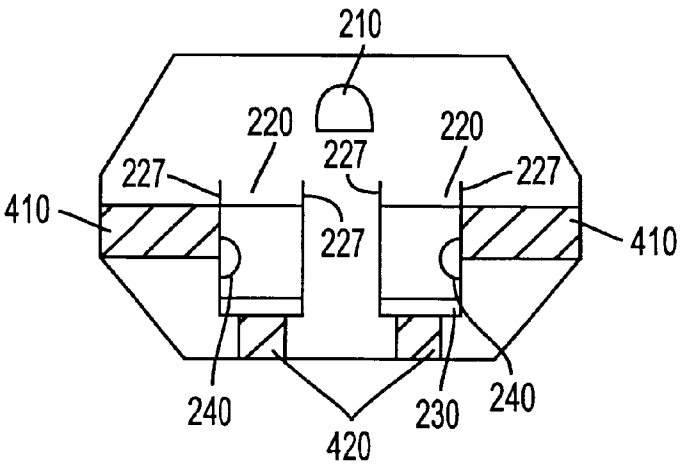
FIG. 6 shows an end view of an exemplary receptacle of the connector system with two sets of adjustment mechanisms.

FIG. 6 shows an end view of an exemplary receptacle of the connector system with two sets of adjustment mechanisms. In this embodiment, a further set of adjustment mechanisms 420 are provided to adjust the pressure with which the second portion of the blade-engaging member 221 and the optional second protrusion 230 are pushed upwardly to engage the optional second receiving portion 130 in the blade. Although the exemplary embodiment shown in FIG. 6 includes adjustment mechanisms 410 and first protrusions 240, the embodiment may rely solely on the optional second protrusion 230 and its further set of adjustment mechanisms 420, as described below, together with or as the sole mechanisms to adjust the protrusion and resist disengagement of the electrical connection.

Figure 7A:
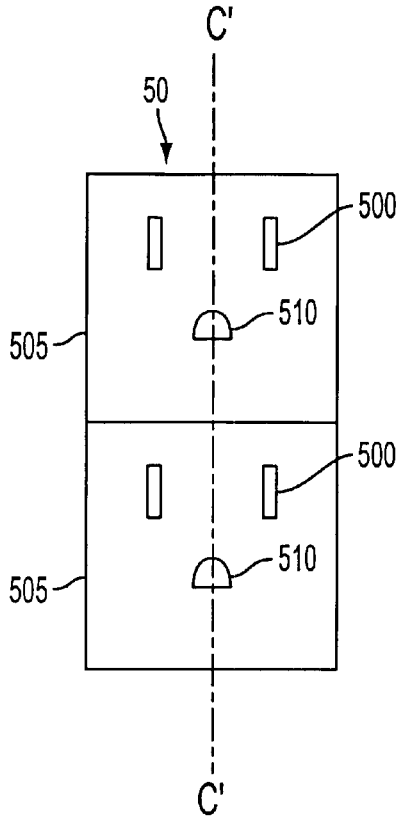
FIGS. 7A and 7B show a wall plug embodiment of the instant invention.
Figure 7B:
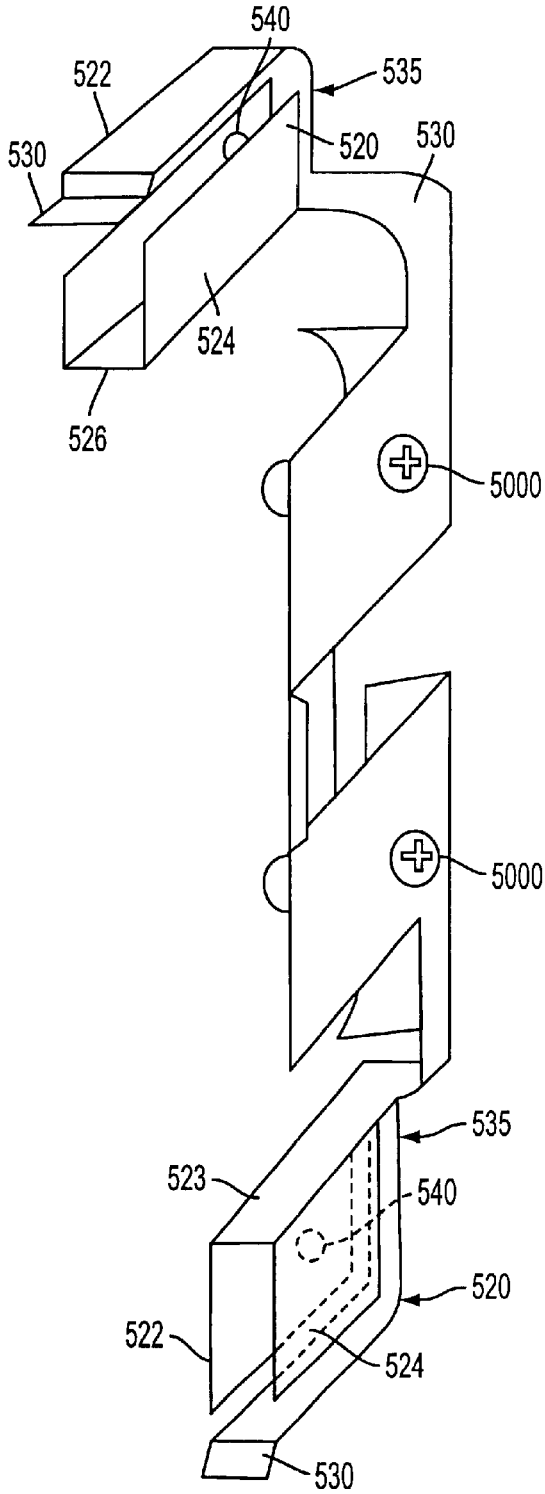

FIGS. 7A and 7B show a wall plug embodiment of the instant invention. FIG. 7A shows a standard wall jack 50 having blade-receiving openings 500 and ground receiving openings 510. However, as seen in FIG. 7B, which is an isometric internal view of the wall plug along line C—C, a wall plug embodiment of the instant invention is located just behind the facia of the wall plug. The embodiment shown in FIG. 7B is a single blade version of the embodiment, one blade receptacle for each outlet 505. A further exemplary embodiment can utilize a second identical receiving member appliance for the second receptacle in each outlet 505.

As shown in FIG. 7B the wall plug embodiment has a blade-engaging member 520, a first protrusion 540, a second portion 522, a bridge portion 535, an upper blade receiving portion 526. The shape of the bridge portion 535 is extended and turned in a different direction than the embodiment of FIGS. 1–6, as evident in FIG. 7B. However, the blade-engaging members 520 function in an identical fashion to that of the first exemplary embodiment, engaging said at least one protrusion within a respective hole or cut-out in a blade. In this case a male plug having at least one blade, as shown in FIG. 1B, is inserted into the blade receiving opening 500. The blade 120, having the first recess 140 and an optional second receiving portion 130 that are engaged by corresponding first and second protrusions 540, 530. Electricity is provided to the blade-receiving members 520 through contact members 5000, which are previously screw down during installation to engage electrical leads. As previously indicated, the embodiments described are non-limiting. For example, although both first and second protrusions 540,530 are shown in FIG. 7B, further embodiments may utilize either of the protrusions exclusively or in combination. Furthermore, in a further exemplary embodiments, one or both blades for each outlet 505 in the wall jack 50 may be engaged by providing a mirror image of the device depicted in FIG. 7B along the opposite side of the outlet aligned to engage the other blades in the outlet.

Figure 8B:
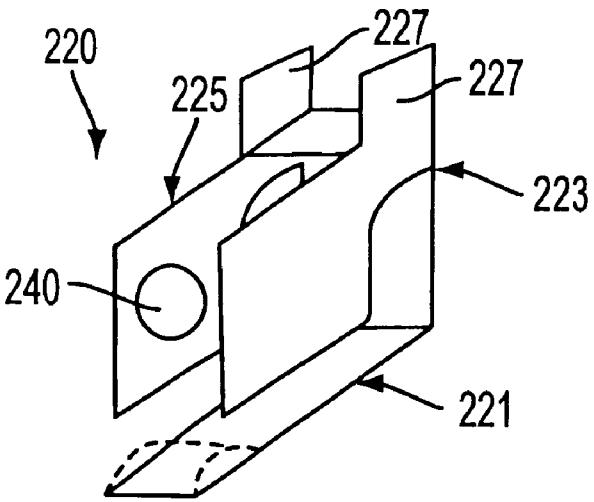
FIGS. 8A and 8B show a further exemplary embodiment of the instant invention with a shortened blade-engaging member.
Figure 8A:
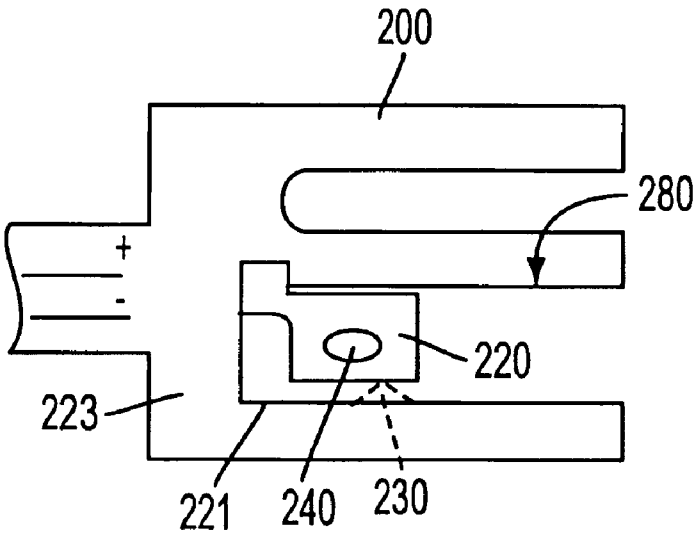

FIGS. 8A and 8B show a further exemplary embodiment with a shortened blade-engaging member. As a further safety feature, the instant invention may be shortened. By shortening the blade-engaging member 220, a blade would need to be fully inserted through a blade guide channel 280 to engage the first protrusion 240 together with or alternatively with the optional second protrusion 230 to allow electrical power to flows through the connection. This is especially useful in preventing the previously mentioned intermittent engagement problem. By requiring the full insertion of the blade members to obtain electrical connection, the positive engagement and retention of the blade members is assured. Note also the lack of an upper portion of the blade engaging member in this exemplary embodiment.

In a further exemplary embodiment for assuring the positive engagement of the blade member, said protrusions 240, 230, can may be switch elements or part of a switch. For example, protrusion 240 may be a contact member for a contact switch in the plug, thereby allowing a complete electrical circuit only upon full insertion of the blade.

The embodiments, exemplary embodiments, and examples discussed herein are non-limiting examples. The invention is described in detail with respect to exemplary embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. An electrical receptacle comprising:

a body member, said body member comprising at least one blade-engaging member having a first and second portion spaced apart from one another, a bridge portion connecting the first and second portion, and at least one side structure extending from said first portion and spaced between said first and second portion;

at least one electrical lead coupled to said body member; and at least one protrusion located on said at least one side structure, proximate to an end of said at least one side structure and closer to but spaced from the bridge portion, said protrusion releasably engaging and disengaging a corresponding blade member absent the presence of an externally actuated release mechanism.

2. The electrical receptacle of claim 1, wherein the electrical lead is coupled to the blade-engaging member.

3. The electrical receptacle of claim 1, wherein said at least one side structure comprises a portion of said body member.

4. The electrical receptacle of claim 1, wherein the at least one protrusion is between about 1 mm and about 10 mm in length.

5. The electrical receptacle of claim 1, wherein the at least one protrusion is between about 1 mm and about 10 mm in width.

6. The electrical receptacle of claim 1, wherein the at least one protrusion is between about 0.5 mm and about 5 mm in height.

7. The electrical receptacle of claim 1, wherein the at least one protrusion has a diameter of between about 1 mm and 10 mm.

8. The electrical receptacle of claim 1, wherein the at least one protrusion is at least one of a circular, ovoid, teardrop, and rounded shape.

9. The electrical receptacle of claim 1, wherein the at least one protrusion is shaped to engage a corresponding number of recesses in a blade member.

10. The electrical receptacle of claim 1, wherein the at least one protrusion further comprises a single protrusion located on said blade-engaging member.

11. The electrical receptacle of claim 1, wherein said at least one protrusion further comprises multiple protrusions.

12. The electrical receptacle of claim 1, further comprising at least one adjustment mechanism in said body member to adjust the position of said at least one protrusion relative to the body member.

13. The electrical receptacle of claim 1, wherein a center portion of said first portion of said blade-engaging member terminates adjacent the bridge portion and said at least one side structure, comprises first and second side structures extending therefrom.

14. The electrical receptacle of claim 1, wherein said electrical connector is mounted in a wall plug.

15. The electrical receptacle of claim 1, wherein said electrical connector is modified for at least one of 110, 220, 440, and 660 volt applications.

16. The electrical receptacle of claim 1, wherein the electrical connector disengages connection upon application of a force of between about three pounds force and fifteen pounds force.

17. The electrical receptacle of claim 1, wherein the at least one protrusion is located on the blade-engaging member.

18. The electrical receptacle of claim 17, wherein the at least one protrusion is located on said first portion of said blade engaging member.

19. The electrical receptacle of claim 1, wherein said at least one protrusion has a first more gradual slope extending from said side structure and a second sharper slope returning to said side structure of said first portion, defining a highest point for engagement between said first and second slopes.

20. The electrical receptacle of claim 19, wherein said first slope extends from said at least one side structure at an angle of between about 3 degrees to about 45 degrees relative to the at least one side structure.

21. The electrical receptacle of claim 19, wherein said second slope returns to said side structure at an angle of between about 20 degrees to about 85 degrees relative to the at least one side structure.

22. The electrical receptacle of claim 1, wherein said at least one protrusion comprises one protrusion located on the second portion of said blade-engaging member.

23. The electrical receptacle of claim 22, wherein said one protrusion engages a corresponding receiving portion in a corresponding portion of the blade member.

24. The electrical receptacle of claim 23, wherein the protrusion further comprises a first part of the protrusion closer to a first end of the body member having a gradually rising first slope from the second portion; and a second part of the protrusion located further from said first end of said body member, having a sharply angled second slope returning to the second portion.

25. The electrical receptacle of claim 24, wherein said first slope rises from said second portion at an angle of between about 3 degrees to about 45 degrees.

26. The electrical receptacle of claim 24, wherein said second slope returns to said second portion at an angle of between about 20 degrees to about 85 degrees.

27. The electrical receptacle of claim 1, wherein said at least one protrusion further comprises a first protrusion and a second protrusion.

28. The electrical receptacle of claim 27, wherein said first protrusion is located on said at least one side structure and said second protrusion is located on the second portion of said blade-engaging member, near an end of the second portion closest to a receiving end of said body member.

29. The electrical receptacle of claim 28, wherein said first protrusion engages a corresponding first recess and said second protrusion engages a corresponding second recess in the blade member.

30. The electrical receptacle of claim 1, the body member further comprising an at least one blade guide channel, corresponding to the at least one blade-engaging member, wherein the at least one blade guide channel precedes the corresponding at least one blade-engaging member and guides the corresponding blade member to said at least one protrusion on said at least one blade-engaging member.

31. The electrical receptacle of claim 30, wherein said at least one blade-engaging member is substantially shorter than said at least one blade member, so as to necessitate full insertion of said blade member into and along said blade guide channel to fully engage said blade-engaging member.

32. The electrical receptacle of claim 1, wherein said at least one protrusion is a component of an electrical switch, wherein said switch is actuated by fully engaging said blade-engaging member and, thereby, said at least one protrusion.

33. The electrical receptacle of claim 32, wherein said electrical switch is at least one of a contact switch and an electrical interrupt switch.

34. The electrical receptacle of claim 19, further comprising at least one adjustment mechanism to effectuate a change in the position of the highest point of the at least one protrusion.

35. The electrical receptacle of claim 34, wherein the at least one adjustment mechanism is at least one of a screw, a resilient member, a ratcheting mechanism or other adjustment mechanism.

36. An electrical connector system comprising:

a male plug member having at least one blade with at least one recess, and;

a female connector having at least one blade-engaging member, said blade-engaging member having first portion, a second portion spaced from said first portion, at least one side structure extending from said first portion and located between said first and second portions, a bridge portion connecting the first and second portion and at least one protrusion, wherein said protrusion is located on said at least one side structure, proximate to an end of said at least one side structure closer to but spaced from the bridge portion, the protrusion being so located on said blade-engaging member engages said at least one recess on said male plug member absent the presence of an externally actuated release mechanism.

37. The electrical connector system of claim 36, wherein said system has a first and second blade and a ground member.

38. The electrical connector system of claim 37, wherein said at least one blade-engaging member comprises a single blade-engaging member, which engages said first blade.

39. The electrical connector system of claim 37, wherein said at least one blade-engaging member comprises first and second blade-engaging members, each engaging a respective first and second blade.

40. The electrical connector system of claim 36, wherein the at least protrusion engages said corresponding at least one at least one blade from a side of said blade furthest from said body member.

41. The electrical connector system of claim 36, wherein the female connector is housed in a wall outlet.

* * * * *